US008240534B2

(12) United States Patent
Hirabayashi

(10) Patent No.: US 8,240,534 B2
(45) Date of Patent: Aug. 14, 2012

(54) DRIVING TOOL

(75) Inventor: Shinji Hirabayashi, Anjo (JP)

(73) Assignee: Makita Corporation, Anjo-Shi (JP)

( * ) Notice: Subject to any disclaimer, the term of this patent is extended or adjusted under 35 U.S.C. 154(b) by 146 days.

(21) Appl. No.: 12/450,185

(22) PCT Filed: Mar. 14, 2008

(86) PCT No.: PCT/JP2008/054797

§ 371 (c)(1),
(2), (4) Date: Oct. 29, 2009

(87) PCT Pub. No.: WO2008/114747

PCT Pub. Date: Sep. 25, 2008

(65) Prior Publication Data

US 2010/0065294 A1 Mar. 18, 2010

(30) Foreign Application Priority Data

Mar. 16, 2007 (JP) ..... 2007-067942

(51) Int. Cl.
*B25C 1/06* (2006.01)

(52) U.S. Cl. ..... 227/131; 227/130; 227/132; 227/133

(58) Field of Classification Search ..... 227/130, 227/131, 132, 133, 120; 173/53, 121, 124
See application file for complete search history.

(56) References Cited

U.S. PATENT DOCUMENTS

| | | | | |
|---|---|---|---|---|
| 2,869,824 A | | 1/1959 | Hazak | |
| 4,042,036 A | * | 8/1977 | Smith et al. | 173/13 |
| 4,129,240 A | | 12/1978 | Geist | |
| 4,189,080 A | | 2/1980 | Smith et al. | |
| 4,323,127 A | * | 4/1982 | Cunningham | 173/53 |
| 4,558,747 A | * | 12/1985 | Cunningham | 173/55 |
| 5,069,379 A | * | 12/1991 | Kerrigan | 227/131 |
| 5,098,004 A | * | 3/1992 | Kerrigan | 227/134 |
| 2007/0102471 A1 | * | 5/2007 | Gross et al. | 227/131 |
| 2009/0294508 A1 | * | 12/2009 | Kunz et al. | 227/131 |

FOREIGN PATENT DOCUMENTS

| | | |
|---|---|---|
| JP | U-55-50701 | 4/1980 |
| JP | A-58-502044 | 12/1983 |
| JP | A-2006-130592 | 5/2006 |
| JP | A-2006-142392 | 6/2006 |
| WO | WO 83/02082 A1 | 6/1983 |

OTHER PUBLICATIONS

May 25, 2011 Search Report issued in European Application No. 08722193.3.

* cited by examiner

*Primary Examiner* — Paul R Durand
*Assistant Examiner* — Nathaniel Chukwurah
(74) *Attorney, Agent, or Firm* — Oliff & Berridge, PLC

(57) ABSTRACT

An object of the application is to improve power transmission to a movable element in a driving tool. The driving tool for driving a material to be driven into a workpiece includes rotationally driven first and second rotating elements, the movable element that can move in a direction that strikes the material to be driven, V-shaped first and second contact surfaces formed on the movable element, and a pressing member that applies a force to the movable element such that the first and second contact surfaces are pressed against the first and second rotating elements. The driving tool further includes a first motor for driving the first rotating element and a second motor for driving the second rotating element.

7 Claims, 12 Drawing Sheets

DRIVING TOOL

FIELD OF THE INVENTION

The invention relates to a driving tool for driving a material to be driven such as a nail into a workpiece.

BACKGROUND OF THE INVENTION

Japanese non-examined laid-open Patent Publication No. 2006-142392A discloses a driving tool using a driving flywheel for driving a driver to drive nails. According to the disclosed nailing machine, the driver is held between a driving flywheel which is rotationally driven by an electric motor and a fixed roller so that the driver is linearly moved.

According to the known art as described above, a linear force to be transmitted from the ® driving wheel to the driver is not enough and in this point of view, further improvement is desired.

SUMMARY OF THE INVENTION

Accordingly, it is an object of the invention to improve an effective power transmission in a driving tool.

In order to achieve the above-described object, a representative driving tool for driving a material into a workpiece is provided to include first and second rotating elements which are spaced apart from each other and rotationally driven, a movable element that moves in a direction that strikes the material to be driven, a pressing member that presses the movable element toward the first and second rotating elements from a direction transverse to the direction of movement of the movable element, and first and second contact surfaces provided on the movable element and extending along the direction of movement of the movable element such that a space between the contact surfaces is lessened toward the front in a pressing direction of the pressing member. The contact surfaces are brought into contact with the first and second rotating elements when the pressing member presses the movable element. The movable element is moved by a rotating force of the first and second rotating elements in a direction that strikes the material to be driven when the first and second contact surfaces come into contact with the first and second rotating elements. Further, the manner of "extending along the direction of movement of the movable element such that a space between the contact surfaces is lessened" in this invention suitably includes both the manner in which one of the first and second contact surfaces is inclined and the manner in which both of the contact surfaces are inclined, and typically, the movable element has a V-shaped or trapezoidal section in a direction transverse to the direction of movement of the movable element. Further, the movable element suitably has an arcuate region on the front end. The manner of "contact" in the invention typically represents the manner in which the first and second contact surfaces come into contact with the circumferential surfaces of the first and second rotating elements, but it also suitably includes the manner in which the first and second contact surfaces come into contact with the side surfaces of the first and second rotating elements.

According to the preferred embodiment of the invention, the movable element is moved by pressing the first and second contact surfaces of the movable element against the first and second rotating elements in the state in which the pair rotating elements are rotationally driven. Thus, the movable element can strike and drive the material to be driven into a workpiece. The "material to be driven" according to the invention typically represents a nail, a staple, etc.

According to the preferred embodiment of the invention, the movable element for driving the material to be driven has the first and second contact surfaces extending along the direction of movement of the movable element such that a space between the contact surfaces is lessened toward the front in a pressing direction of the pressing member, and the first and second contact surfaces are pressed against the first and second rotating elements by the pressing member. Therefore, in the state in which the first and second contact surfaces are pressed by the pressing member, the first and second contact surfaces are engaged (wedged) in between the first and second rotating elements. As a result, power of the rotating elements is efficiently transmitted to the movable element, so that the movable element can provide a higher striking force.

Further, the first and second rotating elements are preferably configured such that their circumferential surfaces come into contact with the first and second contact surfaces in parallel. For example, the axes of rotation of the first and second rotating elements are arranged in a configuration corresponding to the configuration of the first and second contact surfaces, or specifically in V configuration. Alternatively, the axes of rotation of the first and second rotating elements are arranged in parallel to each other, and the circumferential surfaces of the first and second rotating elements each have a conical shape which conforms to the first and second contact surfaces.

In the preferred embodiment of the invention, a first motor for driving the first rotating element and a second motor for driving the second rotating element are provided. Specifically, the pair first and second rotating elements are independently driven by the respective motors.

In order to drive the first and second rotating elements by one motor, for example, in opposite directions, the following two methods are conceivable. One is a power transmission method using a round belt, and the other is a power transmission method using a bevel gear. In the power transmission method using a round belt, one round belt is crossed and looped over a driving pulley which is driven by the motor and over two driven pulleys mounted on the axes of the first and second rotating elements. In this case, due to the crossed configuration of the round belt, disadvantageously, portions of the round belt which are crossed one over the other may contact each other. Moreover, a greater loss of power transmission is caused due to slippage, so that the efficiency of power transmission is impaired. In the power transmission method using a bevel gear, disadvantageously, the gear is expensive, and the gear teeth may be chipped on impact acting upon the gear during the nail driving movement of the movable element.

According to the preferred embodiment of the invention, with the construction in which the first and second rotating elements are independently driven by the respective motors, a direct coupling method in which the rotating elements are directly driven by the motors can be adopted, or alternatively, a power transmission method using a belt looped in parallel can be adopted. In the power transmission method using a parallel looped belt, a V-belt having one or more V-shaped ridges can be used which causes less slippage compared with the power transmission method using a round belt. Specifically, according to this invention, the pair rotating elements can be driven with efficiency and thus the striking force of the movable element can be further increased.

According to a further embodiment of the invention, the first and second motors are spaced apart from each other in the direction of movement of the movable element. The manner in which the first and second motors are "spaced apart from each other in the direction of movement of the movable element" represents the manner in which the motors are arranged such that the distance between the axes of the first rotating element and the first motor for driving the first rotating element is different from the distance between the axes of the second rotating element and the second motor for driving the second rotating element, provided that, for example, the first and second rotating elements are driven via a rotational-power transmission member, such as a belt, a chain and a gear.

The first and second rotating elements are preferably opposed to each other in order to realize stable rectilinear movement of the movable element. In this case, if the first and second rotating elements are arranged in V configuration in which their axes of rotation form a V-shape, the first and second motors are correspondingly arranged in V configuration in which their axes of rotation form a V-shape. If such motors are installed in an existing driving tool, however, depending on the axial length of the motors, the motors may interfere with each other at one axial end, so that the motors cannot be arranged in V configuration. Or, if it is designed to install the motors in such a manner as to avoid such interference between the motors, the driving tool itself may be increased in size. According to the further embodiment of the invention, with the construction in which the first and second motors are spaced apart from each other in the direction of movement of the movable element, such interference can be rationally avoided and the motors can be arranged in V configuration without increase in the size of the driving tool.

According to the invention, the following features may be provided. The first rotating element may be provided on an output shaft of the first motor, and the second rotating element may be provided on an output shaft of the second motor. With this construction, the motors and the rotating elements are directly coupled to each other, so that no loss of power transmission is caused and occurrence of trouble is reduced.

Further, the driving tool may further includes a housing that houses the first and second motors and the first and second rotating elements, and a handle to be held by a user, which is connected to the housing and extends in a direction transverse to the longitudinal direction of the housing. The first and second motors may be arranged in V configuration such that their axes of rotation open up from the front in the pressing direction of the pressing member toward the handle side. With this construction, the width of the housing for housing the motors and the rotating elements can be reduced, so that visibility of a point on the workpiece into which a material to be driven is driven can be enhanced.

Further, rotational outputs of the motors may be transmitted to the rotating elements via V-belts. With this construction, efficient power transmission between the motors and the rotating elements can be realized.

According to this invention, a technique that contributes to an improvement of power transmission to a movable element in a driving tool is provided.

REPRESENTATIVE EMBODIMENT OF THE INVENTION (First Embodiment)

Figure 1:
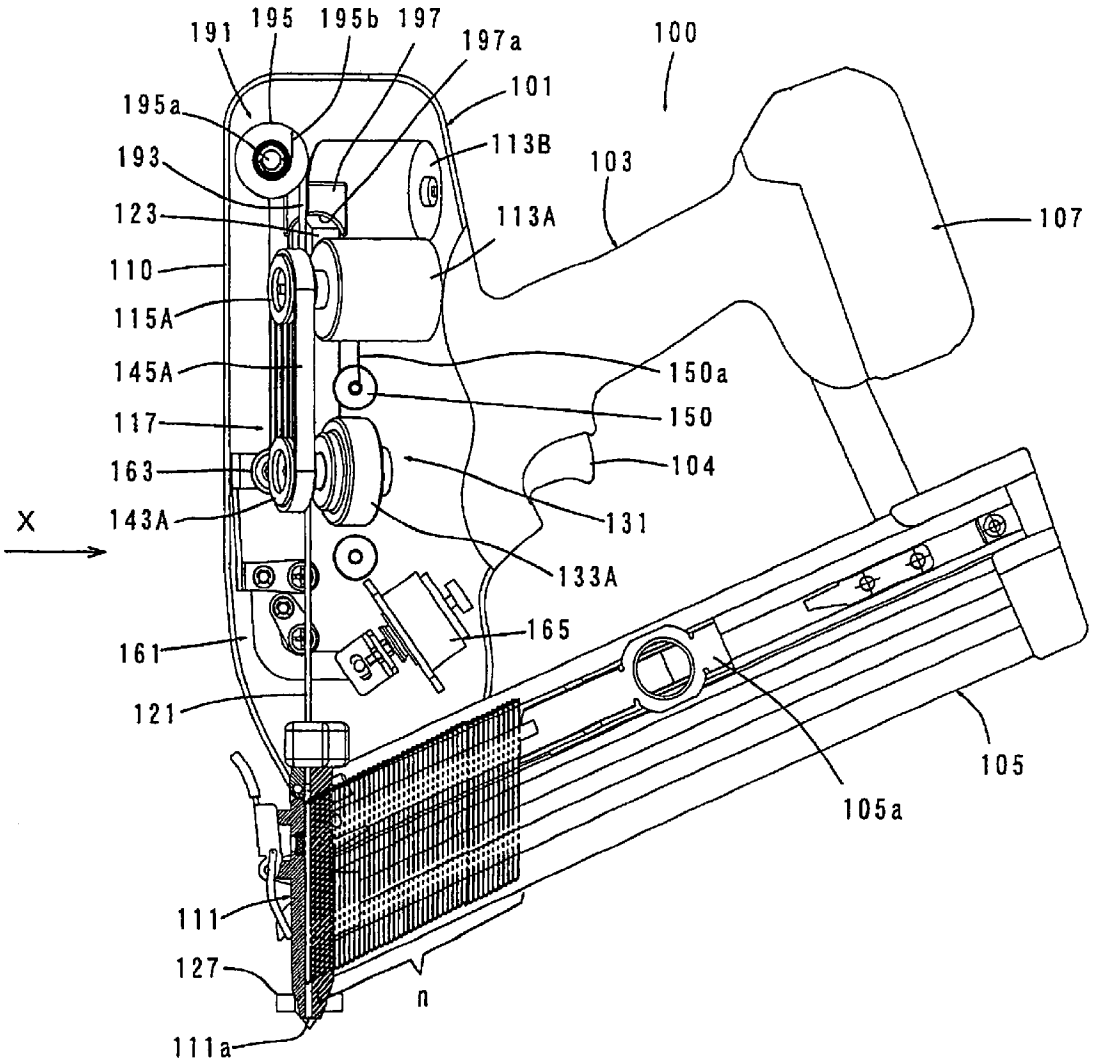
FIG. 1 is a side view showing an entire construction of a nailing machine according to a first embodiment of the invention.
Figure 2:
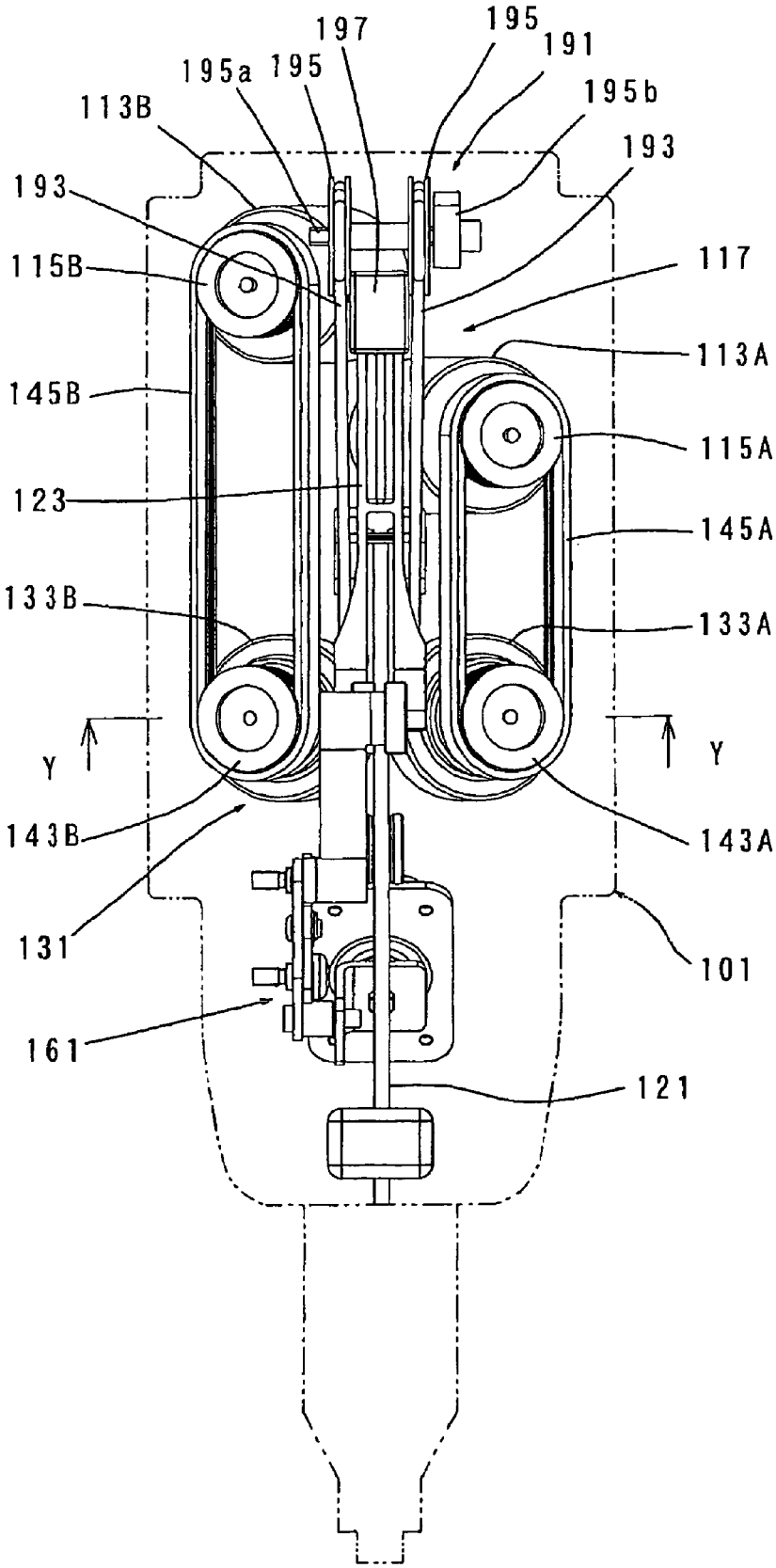
FIG. 2 shows an essential part of the nailing machine as viewed from a direction shown by the arrow X in FIG. 1.
Figure 3:
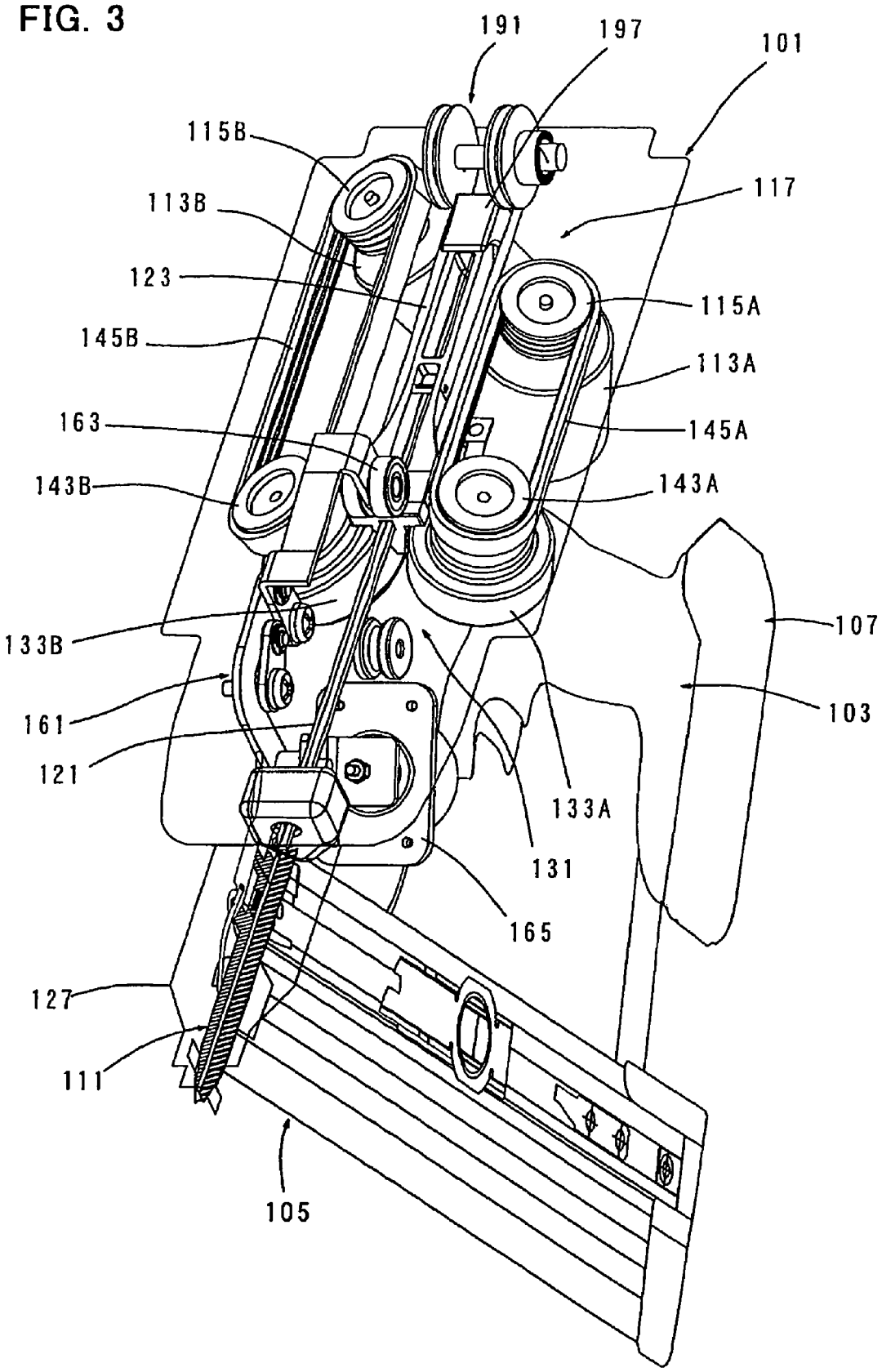
FIG. 3 is a perspective view showing the essential part of the nailing machine of the first embodiment.
Figure 4:
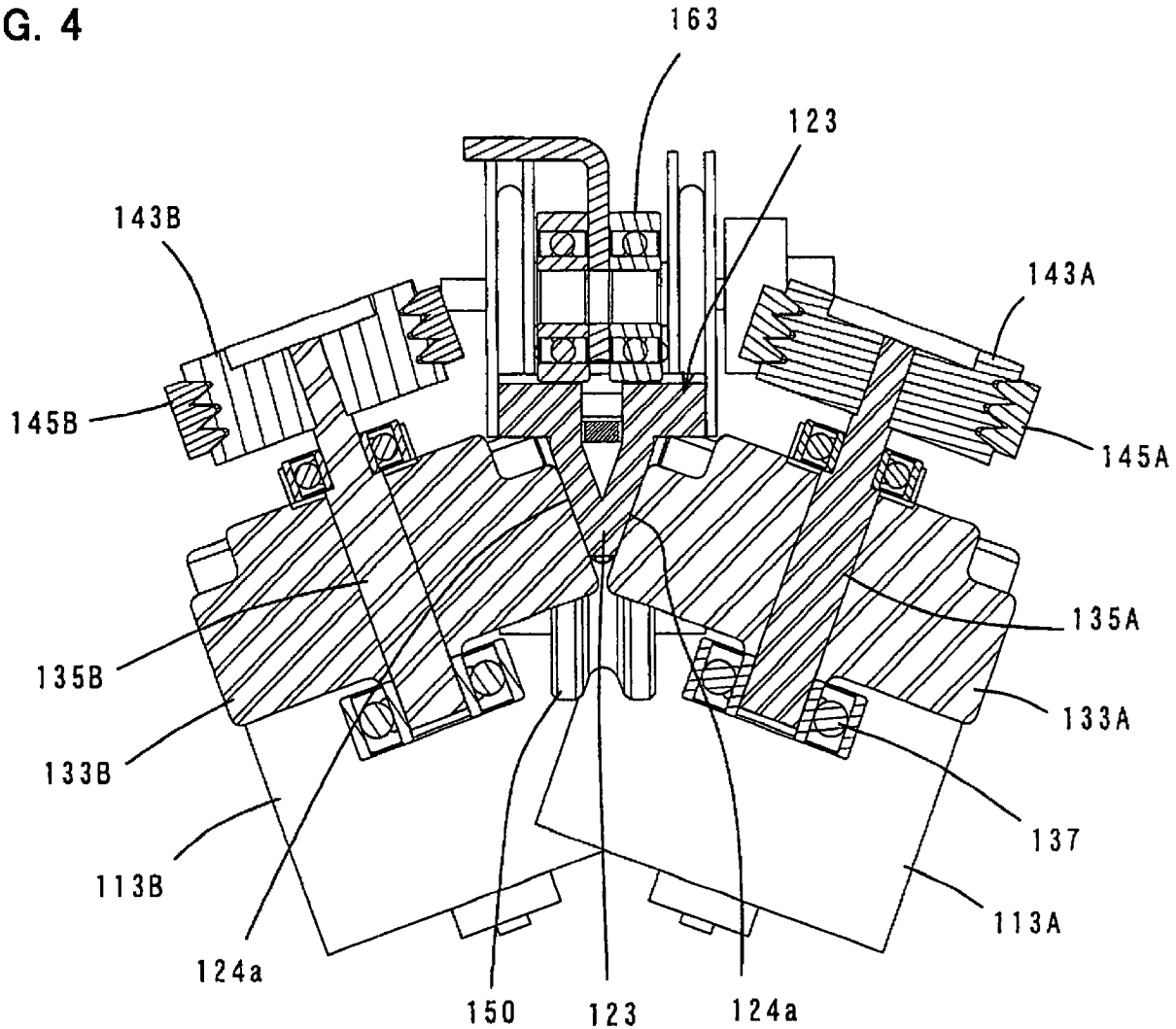
FIG. 4 is a sectional view taken along line Y-Y in FIG. 2.
Figure 5:
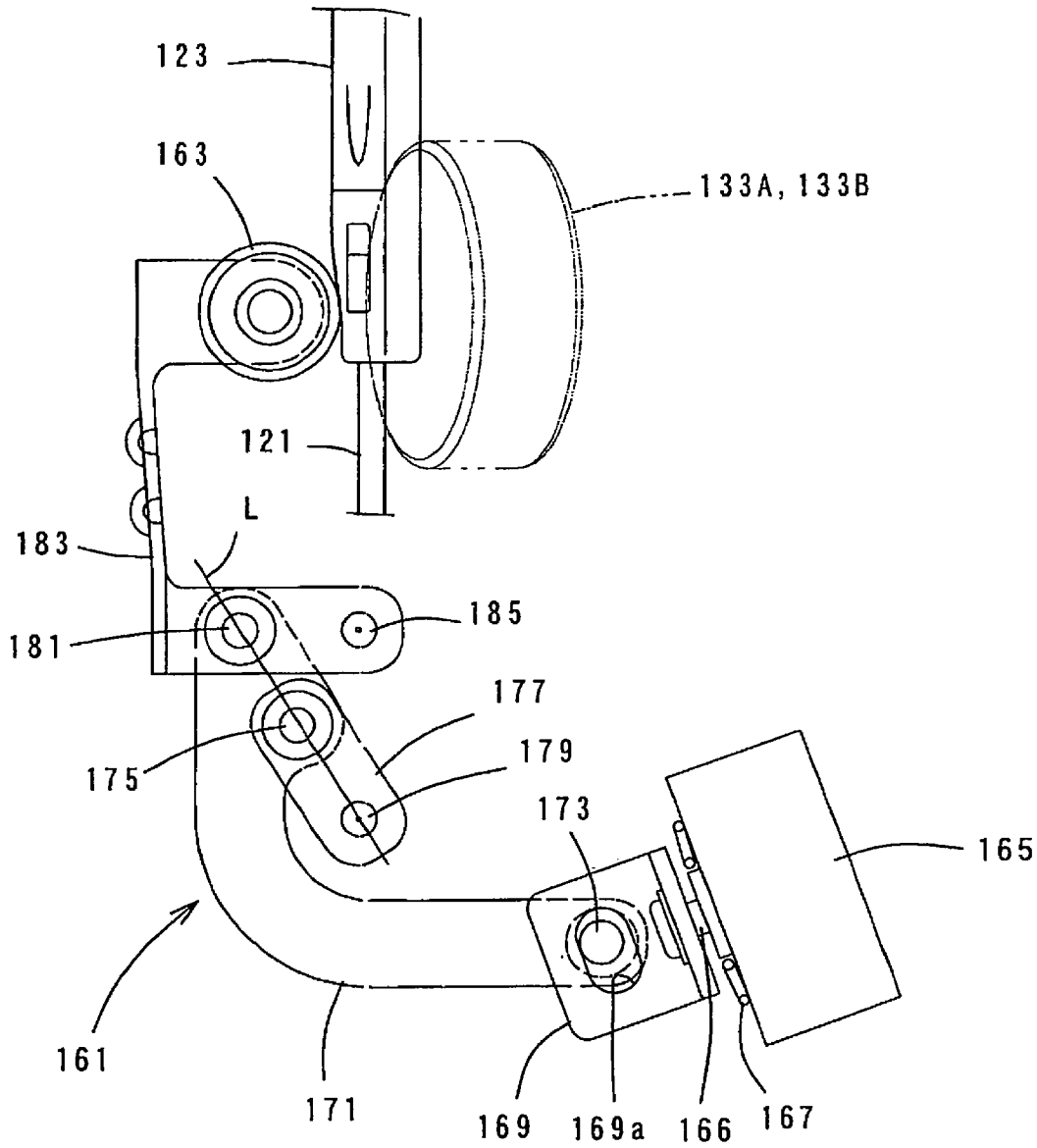
FIG. 5 is a side view showing a pressing mechanism that presses a driver support against a flywheel.
Figure 6:
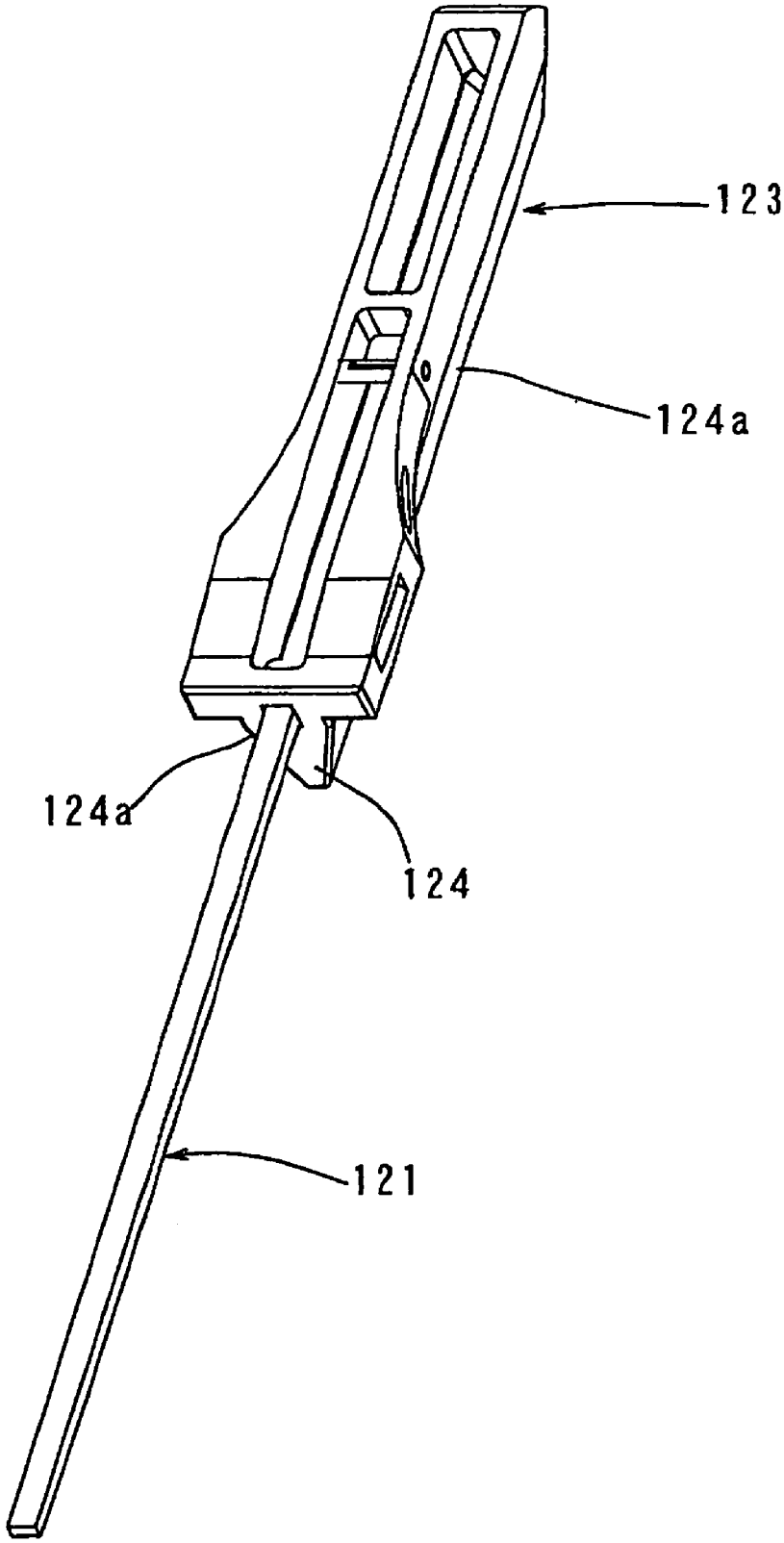
FIG. 6 is a perspective view showing the driver support and a driver.

A first embodiment of the invention is now described with reference to FIGS. 1 to 6. FIG. 1 shows an entire battery-powered nailing machine 100 as a representative example of a driving tool according to the embodiment of the invention. FIG. 2 shows an essential part of the nailing machine as viewed from the direction shown by the arrow X in FIG. 1. FIG. 3 is a perspective view showing the essential part of the nailing machine. FIG. 4 is a sectional view taken along line Y-Y in FIG. 2. Further, FIG. 5 shows a pressing mechanism that presses a driver support against a flywheel, and FIG. 6 shows the driver support and a driver.

As shown in FIG. 1, the nailing machine 100 includes a body 101 that forms an outer shell of the nailing machine 100, a handle 103 to be held by a user, and a magazine 105 that is loaded with nails "n" to be driven into a workpiece. The handle 103 is integrally formed with the body 101 and extends laterally from the side of the body 101. A rechargeable battery pack 107 is mounted on the end of the handle 103, and driving motors 113A, 113B are powered from the rechargeable battery pack 107.

FIG. 1 shows the nailing machine 100 with the tip of the body 101 pointed at a workpiece W. Therefore, a nail driving direction in which a nail "n" is driven (the longitudinal direction of the body 101) and a nail striking direction in which a driver 121 strikes the nail "n" are a downward direction in FIG. 1.

A driver guide 111 is provided on the tip (lower end as viewed in FIG. 1) of the body 101 and forms a nail injection port. The magazine 105 is mounted to extend between the tip of the body 101 and the end of the handle 103, and the end of the magazine 105 on the nail feeding side is connected to the driver guide 111.

The magazine 105 has a pressure plate 105*a* for pushing the nails "n" in the nail feeding direction (leftward as viewed in FIG. 1). The magazine 111 is designed such that the pressure plate 105*a* feeds the nails one by one into a nail injection hole 111*a* of the driver guide 111 from a direction transverse to the nail driving direction. The nail injection hole 111*a* is formed through the driver guide 111 in the nail driving direction. In this specification, the side of the driver guide 111 (the lower side as viewed in FIG. 1) is taken as the front and its opposite side is taken as the rear.

The body 101 is generally cylindrically formed of resin and mainly includes a body housing 110 formed of two halves. The body housing 110 houses the two driving motors 113A, 113B and a nail driving mechanism 117 that is driven by the driving motors 113A, 113B and strikes the nail "n". The two driving motors 113A, 113B are features that correspond to the "first and second motors" according to this invention.

The nail driving mechanism 117 mainly includes a driver 121 that reciprocates in a direction parallel to the nail driving direction and strikes the nail "n", a drive mechanism 131 that transmits rotational output of the driving motor 113 to the driver 121 as linear motion, and a return mechanism 191 that returns the driver 121 to a standby position (initial position) after completion of striking the nail. The standby position is the position to which the driver 121 is returned by the return mechanism 191 and contacts a stopper 197 located in the rear position (the upper position as viewed in FIG. 1) remotest from the driver guide 111.

A driver support 123 is provided generally in the center of the body housing 110 and formed of a rod-like metal material movable in a direction parallel to the nail driving direction via a slide support mechanism which is not shown. The driver 121 is joined to an end (lower end as viewed in FIG. 1) of the driver support 123 in the nail driving direction.

The driver 121 is formed of a rod-like metal material having a generally rectangular section thinner than the driver support 123. The driver 121 extends toward the driver guide 111 and the tip of the driver 121 is located in the inlet (upper opening as viewed in FIG. 1) of the nail injection hole 111*a*. The driver 121 and the driver support 123 are features that correspond to the "movable element" according to this invention, which is shown in its entirety in FIG. 6.

The driver support 123 has a power transmission part 124 having a V-shaped section. The power transmission part 124 is formed generally along the entire length of the driver support 123. Power transmission surfaces 124*a* are provided on the right and left sides of the power transmission part 124 in the nail driving direction and inclined such that the space therebetween is lessened toward the front in a pressing direction of a pressing roller 163 which is described below. Specifically, the power transmission part 124 having a V-shaped section is formed by arranging the right and left power transmission surfaces 124*a* in the form of a letter V. The right and left power transmission surfaces 124*a* are features that correspond to the "first and second contact surfaces" according to this invention.

As shown in FIG. 2, the drive mechanism 131 mainly includes a pair of right and left flywheels 133A, 133B that are rotationally driven at high speed individually by the driving motors 113A, 113B, and a pressure roller 163 that presses the driver support 123 against the flywheels 133A, 133B. The pair flywheels 133A, 133B and the pressure roller 163 are features that correspond to the "first and second rotating element" and the "pressing member", respectively, according to this invention.

As shown in FIG. 4, each of the pair flywheels 133A, 133B has a cylindrical form having a circumferential surface parallel to its axis of rotation, and the pair flywheels are symmetrically arranged with respect to a line running in a direction transverse to the direction of movement of the driver support 123 such that the axes of rotation of the pair flywheels form a V-shape. Specifically, the pair flywheels 133A, 133B are arranged in V configuration such that their circumferential surfaces are parallel to the power transmission surfaces 124*a* of the power transmission part 124 of the driver support 123. The pair flywheels 133A, 133B are rotationally driven at high speed in opposite directions. Therefore, when the right and left power transmission surfaces 124*a* of the driver support 123 are pressed against the circumferential surfaces of the pair flywheels 133A, 133B, the driver support 123 is linearly moved in a nail driving direction by frictional engagement between the power transmission surfaces 124*a* and the flywheel circumferential surfaces.

Shafts 135A, 135B are rotatably supported by a bearing 139. Driven pulleys 143A, 143B are mounted on the respective shaft 135A, 135B and rotate together with the flywheels 133A, 133B. The driven pulleys 143A, 143B are V-pulleys each having three circumferential V-shaped grooves in the circumferential surfaces.

The pair flywheels 133A, 133B are individually driven by the two driving motors 113A, 113B. The two driving motors 113A, 113B are arranged such that their axes of rotation are parallel to the flywheels 133A, 133B. Specifically, the driving motors 113A, 113B are arranged in V configuration as viewed from the nail driving direction (see FIG. 4).

The two driving motors 113A, 113B are arranged such that their directions of rotation are opposite to each other, and driving pulleys 115A, 115B are mounted on the respective output shafts of the driving motors 113A, 113B. Like the driven pulleys 143A, 143B, the driving pulleys 115A, 115B are also V-pulleys each having three circumferential V-shaped grooves in the circumferential surfaces. Driving belts 145A, 145B are looped in parallel over respective pairs of the driving pulleys 115A, 115B and the driven pulleys 143A, 143B. Therefore, the pair flywheels 133A, 133B are individually driven by the respective driving motors 113A, 113B. Each of the driving belts 145A, 145B is a V-belt having three V-shaped ridges. By engagement of the V-shaped ridges and the V-shaped grooves, the driving belts 145A, 145B can realize efficient rotational power transmission with reduced slippage and can be prevented from becoming slipped off the respective pulleys.

Further, in this embodiment, the flywheels 133A, 133B which contact the right and left power transmission surfaces 124*a* of the driver support 123 are individually driven by the respective driving motors 113A, 113B. Therefore, the peripheral velocities of the flywheels 133A, 133B or the rotational speeds of the driving motors 113A, 113B must be synchronized. The method of this synchronization is described below.

Further, as shown in FIGS. 2 and 3, the driving motors 113A, 113B are arranged rearward of the flywheels 133A, 133B or in a rear end part (upper part as viewed in FIG. 1) within the body housing 110 and in positions spaced apart (displaced) from each other in the nail driving direction of the driver support 123. Specifically, the distance between the axes of the one driving motor 113A and the associated flywheel 133A is different from the distance between the axes of the other driving motor 113B and the associated other flywheel 133B.

Further, as shown in FIGS. 1, 3 and 5, the drive mechanism 131 includes a pressing mechanism 161 that presses the driver support 123 against the flywheels 133A, 133B via the pressure roller 163 from the side (from a direction transverse to the nail driving direction). The pressing mechanism 161 has an electromagnetic actuator 165 disposed in a front part (lower part as viewed in FIGS. 1 and 3) within the body housing 110. An output shaft 166 of the electromagnetic actuator 165 is biased toward a protruded position by a compression spring 167. When the electromagnetic actuator 165 is energized, the output shaft 166 moves toward a retracted position against the biasing force of the compression spring 167. When the electromagnetic actuator 165 is de-energized, the output shaft 166 is returned to the protruded position by the compression spring 167.

One end of an actuating arm 171 is connected to the end of the output shaft 166 of the electromagnetic actuator 165 for relative rotation via a bracket 169. A connecting hole 169*a* is formed in the bracket 169 and elongated in a direction perpendicular to the direction of movement of the output shaft 166. The actuating arm 171 is connected to the bracket 169 via a connecting shaft 173 inserted through the connecting hole 169*a*. Therefore, the one end of the actuating arm 171 is connected to the bracket 169 such that it can rotate via the connecting shaft 173 and such that the center of rotation of the actuating arm 171 can be displaced within the range in which the connecting shaft 173 serving as the center of the rotation can move within the connecting hole 169*a*.

The actuating arm 171 is bent in an L-shape and extends rearward (upward as viewed in FIG. 1). One end of a control arm 177 is rotatably connected to the other end of the actuating arm 171 via a first movable shaft 175. The control arm 177 is rotatably connected to the body housing 110 via a first fixed shaft 179. Further, the other end of the actuating arm 171 is rotatably connected to a pressure arm 183 via a second movable shaft 181. The pressure arm 183 is rotatably supported by the body housing 110 via a second fixed shaft 185. The pressure roller 163 is rotatably supported on the rotating end (the upper end as viewed in FIG. 1) of the pressure arm 183.

A biasing roller 150 is rotatably supported by a leaf spring 150*a* which is supported on the body housing 110. The biasing roller 150 is held in contact with the power transmission surfaces 124*a* of the driver support 123 and holds the driver support 123 disengaged from the flywheels 133A, 133B by the biasing force of the leaf spring 150*a*.

In the pressing mechanism 161 thus constructed, when the driver 121 is located in a standby position, the electromagnetic actuator 165 is de-energized and thus the output shaft 166 is returned to the protruded position by the compression spring 167. In this standby state, the proximal end (on the side of the connecting shaft 173) of the actuating arm 171 is displaced obliquely downward right as viewed in FIG. 5. Therefore, the control arm 177 rotates on the first fixed shaft 179, so that the pressure roller 163 cannot press (is disengaged from) the back of the driver support 123. As a result, the power transmission surfaces 124*a* of the driver support 123 are disengaged from the outer circumferential surfaces of the pair flywheels 133A, 133B by the biasing force from the biasing roller 150.

When the electromagnetic actuator 165 is energized, the output shaft 166 is moved to the retracted position against the biasing force of the compression spring 167. At this time, the proximal end of the actuating arm 171 is moved obliquely upward left. Then, the control arm 177 rotates clockwise on the first fixed shaft 179, and the pressure arm 183 rotates clockwise on the second fixed shaft 185. Therefore, the pressure roller 163 presses the back of the driver support 123 and thereby presses the power transmission surfaces 124*a* of the driver support 123 against the outer circumferential surfaces of the pair flywheels 133A, 133B while retracting the biasing roller 150 against the biasing force of the leaf spring 150*a*. At this time, the first fixed shaft 179 of the control arm 177, the first movable shaft 175 serving as a connecting point between the control arm 177 and the actuating arm 171, and the second movable shaft 181 serving as a connecting point between the actuating arm 171 and the pressure arm 183 lie on a line L. Thus, the pressure arm 183 is locked in the state in which the driver support 123 is pressed against the flywheels 133A, 133B by the pressure roller 163.

Specifically, the pressing mechanism 161 locks the pressure roller 163 in the pressed position by means of a toggle mechanism which is formed by the first fixed shaft 179, the first movable shaft 175 and the second movable shaft 181. In this manner, the pressing mechanism 161 serves to hold the driver support 123 pressed against the outer circumferential surfaces of the pair flywheels 133A, 133B. When the driver support 123 is pressed against the outer circumferential surfaces of the pair flywheels 133A, 133B rotating at high speed, the driver 121 is caused to move at high speed toward the driver guide 111 together with the driver support 123 by the rotational energy of the flywheels 133A, 133B. The driver 121 then strikes the nail "n" and drives it into the workpiece.

Next, the return mechanism 191 that returns the driver 121 to the standby position after completion of driving the nail "n" into the workpiece is now explained. As shown in FIG. 2, the return mechanism 191 mainly includes right and left string-like elastic return rubbers 193 for returning the driver 121, right and left winding wheels 195 for winding the return rubbers 193, and a flat spiral spring 195*b* for rotating the winding wheels 195 in the winding direction.

The right and left winding wheels 195 are disposed in a rear region (upper region as viewed in FIG. 1) of the body housing 110 and rotate together with one winding shaft 195*a* rotatably supported by a bearing. The flat spiral spring 195*b* is disposed on the winding shaft 195*a*. One end of the flat spiral spring 195*b* is anchored to the body housing 110, and the other end is anchored to the winding shaft 195*a*. The flat spiral spring 195*b* biases the winding wheels 195 in the winding direction together with the winding shaft 195*a*. One end of each of the right and left return rubbers 193 is anchored to the associated right or left winding wheel 195, and the other end is anchored to the associated side surface of the driver support 123.

The driver 121 is pulled by the return rubber 193 together with the driver support 123 and retained in the standby position in contact with the stopper 197. As shown in FIG. 1, a contact surface 197*a* of the stopper 197 for contact with the driver support 123 has a concave arcuate shape facing forward, and correspondingly, a rear end surface of the driver support 123 has a convex arcuate shape. Thus, the restoring ability of the driver 121 to return to the standby position can be enhanced.

A contact arm 127 is provided on the driver guide 111 and actuated to turn on and off a contact arm switch (not shown) for energizing and de-energizing the driving motor 113. The contact arm 127 is mounted movably in the longitudinal direction of the driver guide 111 (the longitudinal direction of the nail "n") and biased in such a manner as to protrude from the tip end of the driver guide 111 by a spring which is not shown. When the contact arm 127 is in the protruded position, the contact arm switch is in the off position, while, when the contact arm 127 is moved toward the body housing 110, the contact arm switch is placed in the on position. Further, a trigger 104 is provided on the handle 103 and designed to be depressed by the user and returned to its initial position by releasing the trigger. When the trigger 104 is depressed, a trigger switch (not shown) is turned on and the electromagnetic actuator 165 of the pressing mechanism 161 is energized. When the trigger 104 is released, the trigger switch is turned off and the electromagnetic actuator 165 is de-energized.

The method of synchronizing the rotational speeds of the driving motors 113A, 113B is now explained.

In this embodiment, the right and left power transmission surfaces 124*a* of the driver support 123 contact the circumferential surfaces of the flywheels 133A, 133B which are rotationally driven by the driving motors 113A, 113B, and the driver support 123 is driven by the frictional force between the right and left power transmission surfaces 124*a* and the flywheels 133A, 133B. Therefore, the peripheral velocities of the flywheels 133A, 133B or the rotational speeds of the driving motors 113A, 113B must be synchronized. Thus, in this embodiment, the flywheels 133A, 133B which are rotationally driven by the driving motors 113A, 113B, or the driving motors 113A, 113B cooperate to drive the driver support 123.

Conventionally, in order to synchronize the rotational speeds of two motors, for example, the rotational speed of one of the motors may be controlled according to the difference of the rotational speeds of the two motors. For example, a rotational-speed controller is provided on one of the motors, and a rotational-speed detector is provided on each of the motors. The rotational-speed controller provided on the one motor detects the difference of the rotational speeds of the two motors which are detected by the rotational-speed detectors provided on the both motors, and controls the voltage or current to be supplied to the one motor according to the detected difference of the rotational speeds of the two motors. As an alternative method, a rotational-speed controller for controlling the rotational speed of a motor may be provided on each of the motors, and the rotational speeds of the both motors may be controlled to the same speed setting. In these conventional methods of synchronization, however, a complex and expensive rotational-speed controller is required.

In this embodiment, therefore, the following method is used to synchronize the rotational speeds of the two driving motors 113A, 113B which drive the driver support 123 in cooperation.

As for motors, such as a DC magnet motor, a DC brushless motor and a universal motor, rotational speed N is represented by the following equation:

$$N=(V-I\times R)/K_E$$

where V is a terminal voltage of the motor, I is a current of the motor, R is an armature resistance of the motor, and $K_E$ is a constant. In this equation, voltage drop which may be caused by contact resistance of a brush of the DC motor is ignored.

Further, torque T is represented by the following equation:

$$T=K_T\times I$$

where $K_T$ is a constant.

From the above equations, in the above-described motor, when it is connected to a constant-voltage power source, the current I of the motor and thus the rotational speed N of the motor change with change of the load (torque T) on the motor. For example, when the load on the motor increases, the current I of the motor increases and the rotational speed N of the motor decreases.

In this embodiment, the driving motors 113A, 113B are selected from among a DC magnet motor, a DC brushless motor and a universal motor.

Figure 7:
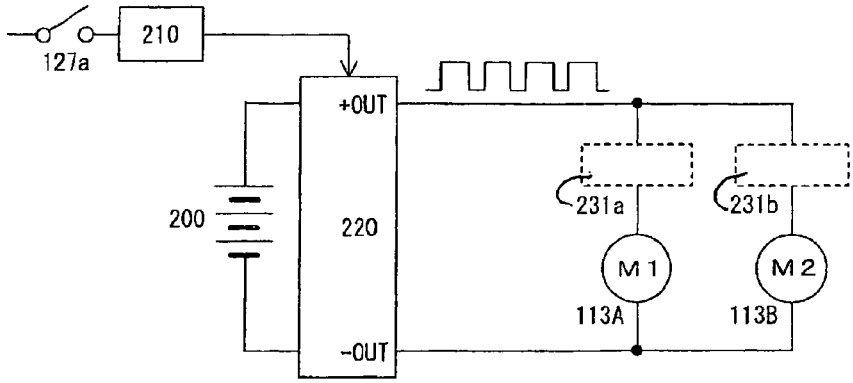
FIG. 7 is a diagram showing connection between driving motors and a battery.

As shown in FIG. 7, the driving motors 113A, 113B are connected in parallel to output terminals of a voltage regulating circuit 220. The voltage regulating circuit 220 is formed, for example, by a PWM control circuit that inputs a DC voltage of a battery 200 and outputs a voltage pulse having a specified duty ratio (=on period/off period) from an output terminal (+OUT). The output terminal (+OUT) shown in FIG. 7 is a feature that corresponds to the "common output terminal of the voltage regulating circuit" according to this invention. In this case, the voltage of the DC power source which is outputted from the output terminal (+OUT) of the voltage regulating circuit 220 (the terminal voltage of the motors 113A, 113B) corresponds to the duty ratio of the voltage pulse which is outputted from the voltage regulating circuit 220. Specifically, the rotational speeds N of the driving motors 113A, 113B are defined according to the load (current I) from the above-described equation and the terminal voltage V having a value corresponding to the duty ratio of the voltage pulse which is outputted from the voltage regulating circuit 220.

Driving circuits 231*a*, 231*b* serve to select an armature winding for supplying the voltage pulse, according to the position of the rotor. The driving circuits 231*a*, 231*b* are used when brushless motors are used as the driving motors 113A, 113B.

Further, a rotational-speed setter for setting the rotational speed may also be provided and the voltage regulating circuit 220 may be configured to output a voltage pulse with a duty ratio corresponding to a rotational-speed setting set by the rotational-speed setter. Moreover, the voltage regulating circuit 220 may also be configured to output a voltage pulse with a duty ratio of 100% (off period=0).

Further, a control circuit 210 is provided and on/off signals of a contact 127*a* of the above-described contact arm 127 are inputted into the control circuit 210. When an on signal of the contact 127*a* is inputted (the contact arm 127 is in the protruded position), the control circuit 210 outputs a start signal to the voltage regulating circuit 220. When the start signal is outputted from the control circuit 210, the voltage regulating circuit 220 supplies a voltage pulse with a specified duty ratio from the output terminal (+OUT) to the first motor 113A and the second motor 113B. On the other hand, when an off signal of the contact 127*a* is inputted (the contact arm 127 is moved to the body housing 110 side), the control circuit 210 outputs a stop signal to the voltage regulating circuit 220. When the stop signal is outputted from the control circuit 210, the voltage regulating circuit 220 stops supplying the voltage pulse to the driving motors 113A, 113B.

Thus, in the state in which a voltage pulse with a specified duty ratio is applied to the driving motors 113A, 113B (the driving motors 113A, 113B are connected to the constant-voltage power source), the rotational speeds of the driving motors 113A, 113B are automatically synchronized.

If the flywheels 133A, 133B have the same diameter, the peripheral velocities of the flywheels 133A, 133B are the same or synchronized when the rotational speeds of the driving motors 113A, 113B that rotationally drive the respective flywheels 133A, 133B are the same. In this case, if the rotational speeds of the flywheels 133A, 133B that are driven by the driving motors 113A, 113B are different, the load on the driving motor 113A or 113B that drives one of the flywheels 133A, 133B which has a higher rotational speed than the other is increased. As a result, the current of the driving motor under the increased load is increased, so that its rotational speed is reduced. For example, if the rotational speed of the flywheel 133A is higher than that of the flywheel 133B, the load on the driving motor 113A that drives the flywheel 133A is increased, so that the rotational speed of the driving motor 113A is reduced. The rotational speed of the driving motor 113A is reduced to that of the driving motor 113B or reduced until the peripheral velocities of the flywheels 133A, 133B are synchronized.

Thus, in this embodiment, a motor of which rotational speed varies according to change of the load (such as a DC magnet motor, a DC brushless motor and a universal motor) is used as the driving motors 113A, 113B that rotationally drive the respective flywheels 133A, 133B. Further, the driving motors 113A, 113B are connected to the constant-voltage power source. With this configuration, the driving motors 113A, 113B that drive the driver support 123 in cooperation can be readily and economically synchronized.

Although, in FIG. 7, the DC voltage of the battery 200 is regulated by the voltage regulating circuit 220 and applied to the driving motors 113A, 113B, the DC voltage of the battery 200 can also be applied to the driving motors 113A, 113B without using the voltage regulating circuit 220. The DC voltage of the battery 200 is held generally constant in normal times. Therefore, even when the DC voltage of the battery 200 is applied to the driving motors 113A, 113B without using the voltage regulating circuit 220, it can be said that "the driving motors 113A, 113B are connected to the constant-voltage power source". In this case, for example, the contact 127*a* of the contact arm switch is connected between the battery 200 and the driving motors 113A, 113B.

Further, although, in FIG. 7, the control circuit 210 and the voltage regulating circuit 220 are used, one control circuit having both the function of the control circuit 210 and the function of the voltage regulating circuit 220 may be used.

Operation and usage of the nailing machine 100 constructed as described above is now explained. When the user holds the handle 103 and presses the contact arm 127 against the workpiece, the contact arm 127 is pushed by the workpiece and retracts toward the body housing 110. Thus, the contact arm switch is turned on and the driving motors 113A, 113B are energized. The rotational outputs of the driving motors 113A, 113B are transmitted to the flywheels 133A, 133B via the driving pulleys 115A, 115B, the driving belts 145A, 145B and the driven pulleys 143A, 143B, and then the flywheels 133A, 133B are rotationally driven at a predetermined rotational speed.

In this state, when the trigger 104 is depressed, the trigger switch is turned on and the electromagnetic actuator 165 is energized, so that the output shaft 166 is retracted. As a result, the actuating arm 171 is displaced, and the pressure arm 183 rotates on the second fixed shaft 185 in the pressing direction and presses the back of the driver support 123 with the pressure roller 163. The driver support 123 pressed by the pressure roller 163 is pressed against the outer circumferential surface of the pair flywheels 133A, 133B. Therefore, the driver 121 is caused to move linearly in the nail driving direction together with the driver support 123 by the rotational force of the flywheels 133A, 133B. The driver 121 then strikes the nail "n" with its tip and drives it into the workpiece. At this time, the return rubber 193 is wound off the winding wheel 195 and the flat spiral spring 195*b* is wound up.

When the trigger 104 is released after completion of driving the nail "n" by the driver 121, the electromagnetic actuator 165 is de-energized. As a result, the output shaft 166 of the electromagnetic actuator 165 is returned to the protruded position by the compression spring 167, and thus the actuating arm 171 is displaced. When the actuating arm 171 is displaced, the first movable shaft 175 is displaced off the line connecting the first fixed shaft 179 and the second movable shaft 181, so that the toggle mechanism is released. Further, the pressure arm 183 is caused to rotate counterclockwise on the second fixed shaft 185, so that the pressure roller 163 is disengaged from the driver support 123.

Upon disengagement of the pressure roller 163, the driver support 123 is pulled by the return rubber 193 and returned to the standby position in contact with the stopper 197 as shown in FIG. 1. The return rubber 193 has its own elasticity in its contracting direction, and it is wound up by the winding wheel 195 spring-biased in the winding direction. Therefore, even if the driver support 123 is moved in a large stroke in the nail driving direction, the driver support 123 can be reliably returned to its standby position. Further, permanent set of the return rubber 193 in fatigue can be reduced, so that the durability can be enhanced.

When the driving motors 113A, 113B are simultaneously energized when starting the driving motors 113A, 113B, the voltage of the battery 200 is reduced by starting currents of the driving motors 113A, 113B. By such reduction of the battery voltage, the following problems may be caused.

In a power tool, a battery detector may be provided which detects the remaining battery level of the battery 200 based on the battery voltage. When the battery voltage is reduced by the starting currents of the driving motors 113A, 113B, the battery detector may provide a false detection even if the battery 200 is not exhausted. Further, the start time of the driving motors 113A, 113B may become longer.

Therefore, it is preferable to start the driving motors 113A, 113B while inhibiting reduction of the battery voltage (this method is referred to as "soft start").

A battery voltage reduction inhibiting device for inhibiting voltage reduction of the battery at the start of the driving motors 113A, 113B is explained below.

Figure 8:
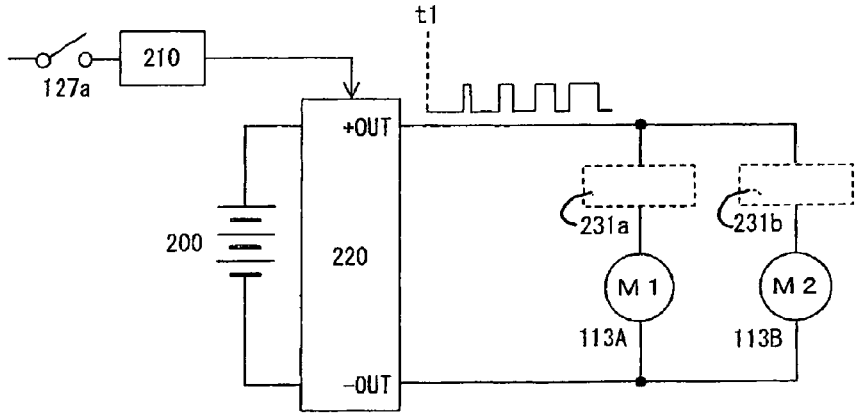
FIG. 8 shows a first embodiment of a battery voltage reduction inhibiting device.

FIG. 8 shows a first embodiment of the battery voltage reduction inhibiting device. In the battery voltage reduction inhibiting device shown in FIG. 8, when the driving motors 113A, 113B are started, a voltage to be applied to the driving motors 113A, 113B is gradually increased. For example, the duty ratio of the voltage pulse which is outputted from the output terminal (+OUT) of the voltage regulating circuit 220 is gradually increased. The battery voltage reduction inhibiting device shown in FIG. 8 is formed by the voltage regulating circuit 220.

When a start signal is outputted from the control circuit 210, first, the voltage regulating circuit 220 outputs a voltage pulse having a lower duty ratio. Thereafter, the duty ratio of the voltage pulse is gradually increased to a specified value (for example, to a duty ratio corresponding to the speed setting).

Figure 9:
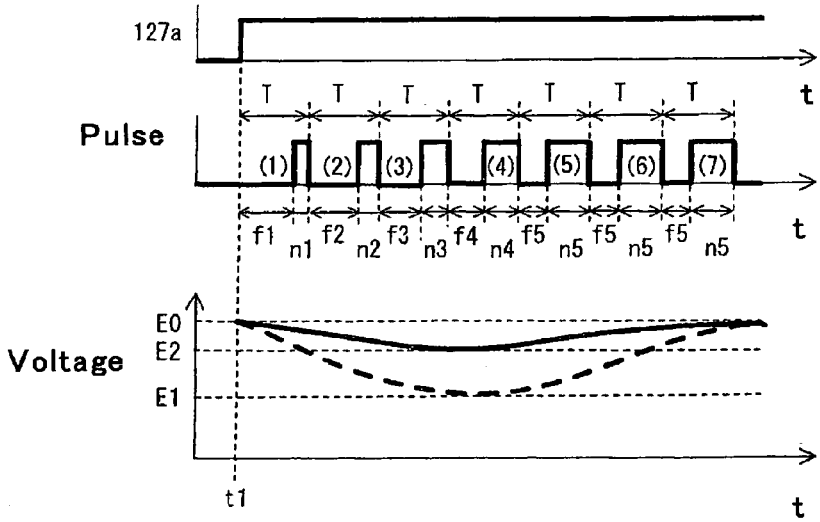
FIG. 9 is a time chart for explaining operation of the first embodiment of the battery voltage reduction inhibiting device.

FIG. 9 shows operation of the battery voltage reduction inhibiting device shown in FIG. 8 according to the first embodiment.

In FIG. 9, a start signal is outputted from the control circuit 210 at time t1. When the start signal is outputted from the control circuit 210 at time t1, the voltage regulating circuit 220 gradually increases the duty ratio of the voltage pulse (or gradually increases [on period n/off period f] in a period T) from n1/f1 to n5/f5. As a result, starting currents of the driving motors 113A, 113B are reduced, so that voltage reduction of the battery 200 is inhibited. For example, if a battery voltage reduction inhibiting device is not used, the battery voltage at the start of the driving motors 113A, 113B becomes E1, while, if the battery voltage reduction inhibiting device according to the first embodiment is used, it becomes E2 (>E1).

Figure 10:
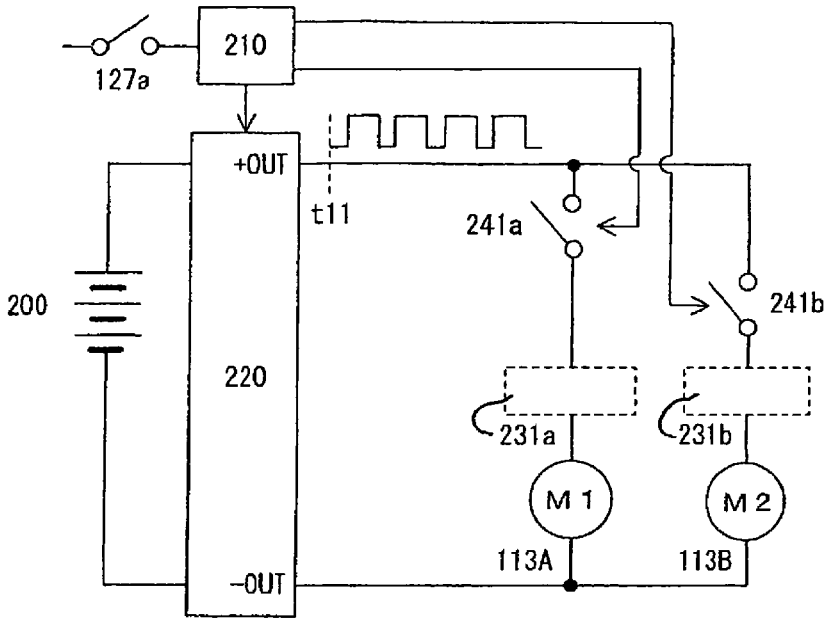
FIG. 10 shows a second embodiment of the battery voltage reduction inhibiting device.

FIG. 10 shows a second embodiment of the battery voltage reduction inhibiting device. In the battery voltage reduction inhibiting device shown in FIG. 10, when the driving motors 113A, 113B are started, times at which a voltage is applied to the driving motors 113A, 113B are shifted. For example, the timings of start of the driving motors 113A, 113B are shifted. The battery voltage reduction inhibiting device shown in FIG. 10 is formed by the control circuit 210 and switches 241*a*, 241*b*. If the voltage regulating circuit 220 has a function of the control circuit 210, it is formed by the voltage regulating circuit 220 and the switches 241*a*, 241*b*.

When a start signal is outputted from the control circuit 210, the voltage regulating circuit 220 outputs a voltage pulse having a specified duty ratio from the output terminal (+OUT). At this time, when the control circuit 210 outputs the start signal, first, the control circuit 210 turns on the switch 241*a* which is assigned to the driving motor 113A. Accordingly, application of the voltage pulse to the driving motor 113A is started. The switch 241*a* may be omitted. Then, after a lapse of specified time since start of application of the voltage pulse to the driving motor 113A, the control circuit 210 turns on the switch 241*b* which is assigned to the driving motor 113B. Accordingly, application of the voltage pulse to the driving motor 113B is started.

Figure 11:
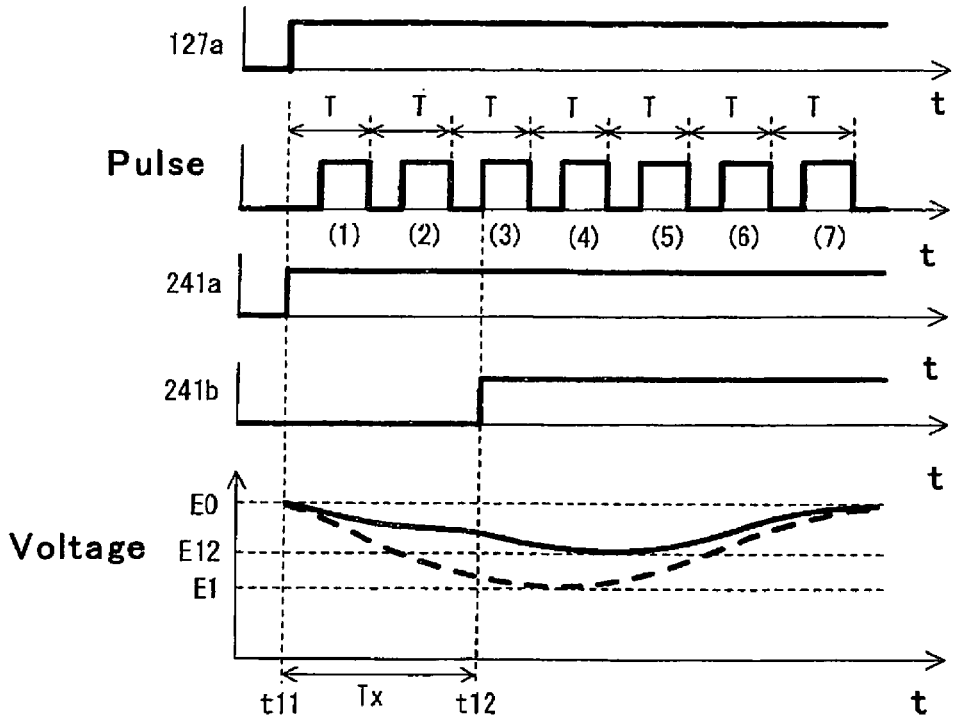
FIG. 11 is a time chart for explaining operation of the second embodiment of the battery voltage reduction inhibiting device.

FIG. 11 shows operation of the battery voltage reduction inhibiting device shown in FIG. 10 according to the second embodiment.

A start signal is outputted from the control circuit 210 at time t11. At time t11, the switch 241*a* is turned on and application of the voltage pulse to the driving motor 113A is started. At this time, compared with the case in which the driving motors 113A, 113B are simultaneously started, the starting current is smaller because the voltage pulse is applied only to the driving motor 113A. Therefore, reduction of the battery voltage is smaller. Then, after a lapse of specified time Tx since time t11, the switch 241*b* is turned on and application of the voltage pulse to the driving motor 113B is started. At this point of time, compared with the case in which the driving motors 113A, 113B are simultaneously started, the starting current is smaller because the starting current of the driving motor 113A is smaller. Therefore, voltage reduction of the battery 200 is inhibited. For example, if a battery voltage reduction inhibiting device is not used, the battery voltage at the start of the driving motors 113A, 113B becomes E1, while, if the battery voltage reduction inhibiting device according to the second embodiment is used, it becomes E12 (>E1).

Figure 12:
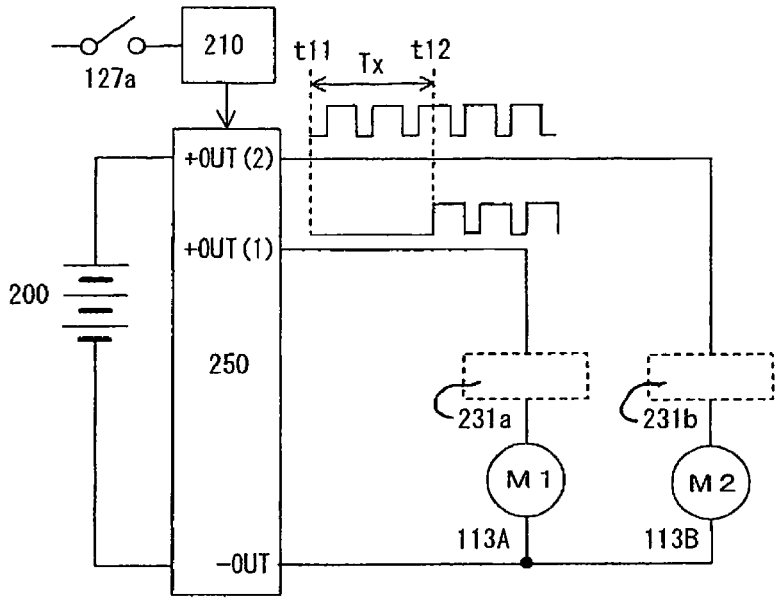
FIG. 12 shows a modification to the second embodiment of the battery voltage reduction inhibiting device.

FIG. 12 shows a modification to the second embodiment of the battery voltage reduction inhibiting device. In the battery voltage reduction inhibiting device shown in FIG. 12, a voltage regulating circuit 250 is used. The voltage regulating circuit 250 is formed, for example, by a PWM control circuit that inputs a voltage of the battery 200 and outputs first and second voltage pulses each having a specified duty ratio from a first output terminal (+OUT1) and a second output terminal (+OUT2). The driving motor 113A is connected to the first output terminal (+OUT1) and the driving motor 113B is connected to the second output terminal (+OUT2). The times at which the first and second voltage pulses are outputted from the first output terminal (+OUT1) and the second output terminal (+OUT2) (for example, voltage pulse rise time) can be appropriately set. The battery voltage reduction inhibiting device shown in FIG. 12 is formed by the voltage regulating circuit 250.

The first output terminal (+OUT1) and the second output terminal (+OUT2) are features that correspond to the "plurality of output terminals of the voltage regulating circuit" according to this invention.

When a start signal is outputted from the control circuit 210 at time t11, first, the voltage regulating circuit 250 outputs a first voltage pulse having a specified duty ratio from the first output terminal (+OUT1). Accordingly, application of the voltage pulse to the driving motor 113A is started. Then, at time t12 after a lapse of specified time Tx since start of output of the first voltage pulse from the first output terminal (+OUT1) (since start of application of the voltage pulse to the driving motor 113A), the voltage regulating circuit 250 outputs a second voltage pulse having a specified duty ratio from the second output terminal (+OUT2). Accordingly, application of the voltage pulse to the driving motor 113B is started.

Further, in this embodiment of the invention, when the driver support 123 is driven, it is only necessary that the rotational speed of the driving motor 113A and the rotational speed of the driving motor 113B are synchronized. Therefore, in a steady state after start of the driving motors 113A, 113B, the first and second voltage pulses outputted from the first output terminal (+OUT1) and the second output terminal (+OUT2) of the voltage regulating circuit 250 may have different phases.

The voltage regulating circuit 250 shown in FIG. 12 can also be used in place of the voltage regulating circuit 220 shown in FIG. 8. In this case, for example, the driving motor 113A is connected to the first output terminal (+OUT1) of the voltage regulating circuit 250 and the driving motor 113B is connected to the second output terminal (+OUT2). When a start signal is outputted from the control circuit 210, the voltage regulating circuit 250 outputs first and second voltage pulses each having a duty ratio which is gradually increased, from the first output terminal (+OUT1) and the second output terminal (+OUT2).

Figure 13:
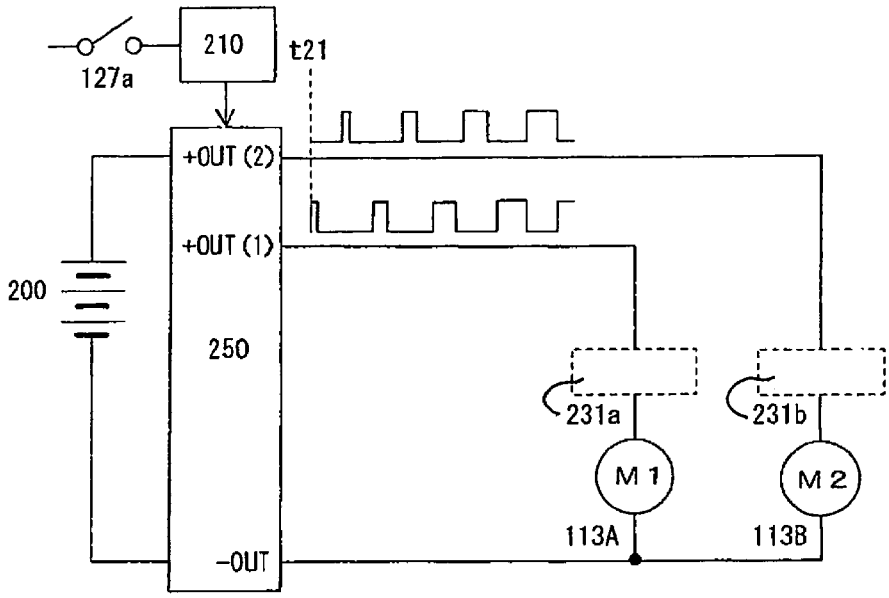
FIG. 13 shows a third embodiment of the battery voltage reduction inhibiting device.

FIG. 13 shows a third embodiment of the battery voltage reduction inhibiting device. In the battery voltage reduction inhibiting device shown in FIG. 13, when the driving motors 113A, 113B are started, the voltage applied to the driving motors 113A, 113B is gradually increased, and times at which the voltage is applied to the driving motors 113A, 113B are shifted. The battery voltage reduction inhibiting device shown in FIG. 13 is formed by the voltage regulating circuit 250. The voltage regulating circuit 250 is formed, for example, by a PWM control circuit that inputs a voltage of the battery 200 and outputs first and second voltage pulses each having a specified duty ratio from a first output terminal (+OUT1) and a second output terminal (+OUT2).

Figure 14:
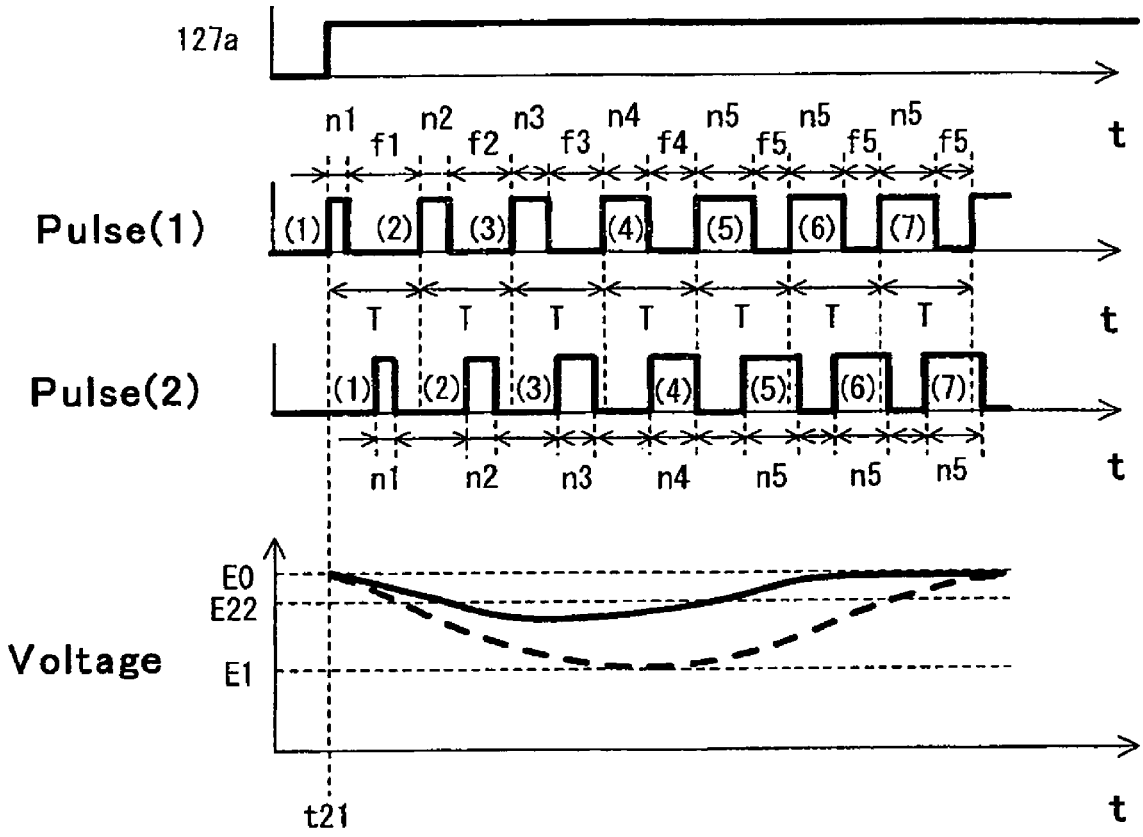
FIG. 14 is a time chart for explaining operation of the third embodiment of the battery voltage reduction inhibiting device.

When a start signal is outputted from the control circuit 210, first, the voltage regulating circuit 250 outputs first and second voltage pulses each having a lower duty ratio from the first output terminal (+OUT1) and the second output terminal (+OUT2). Thereafter, the duty ratios of the first and second voltage pulses which are outputted from the first output terminal (+OUT1) and the second output terminal (+OUT2) are gradually increased to specified values. At this time, the times at which the first and second voltage pulses are outputted are shifted such that the first and second voltage pulses are not simultaneously outputted. For example, the rise times of the first and second voltage pulses are shifted. In FIG. 14, the rise time of the first voltage pulse is set in the first half of the pulse period T, and the rise time of the second voltage pulse is set in the second half of the pulse period T.

Here, the starting currents of the driving motors 113A, 113B are reduced in several pulse periods. Therefore, it is sufficient if it is designed such that, only for several pulse periods (only for the time period during which several voltage pulses are applied), the duty ratios of the first voltage pulse and the second voltage pulse are reduced and the first and second voltage pulses are not simultaneously outputted. In FIG. 14, the duty ratios of the first to fifth ones of the first voltage pulses and the first to fifth ones of the second voltage pulses are gradually increased from n1/f1 to n5/f5. Further, the times at which the first and second voltage pulses are outputted are controlled such that the first to fourth ones of the first and second voltage pulses are not simultaneously outputted.

Further, as described above, in a steady state after start of the driving motors 113A, 113B, the first and second voltage pulses outputted from the first output terminal (+OUT1) and the second output terminal (+OUT2) of the voltage regulating circuit 250 may have different phases. Naturally, one of the phases of the first and second voltage pulses may be regulated such that the phases of the first and second voltage pulses coincide.

The battery voltage reduction inhibiting device according to the third embodiment can apply driving pulses to the driving motors 113A, 113B substantially at the same time, so that it can start the driving motors 113A, 113B in a shorter time while inhibiting voltage reduction of the battery.

In the present embodiment of the invention, the driver support 123 has the power transmission surfaces 124*a* which are arranged to form the V-shaped section, and the driver support 123 is linearly moved when the power transmission surfaces 124*a* are pressed against the circumferential surface of the flywheels 133A, 133B arranged in V configuration. Therefore, the power transmission surfaces 124*a* of the driver support 123 are engaged (wedged) in between the circumferential surfaces of the flywheels 133A, 133B. As a result, power is efficiently transmitted from the flywheels 133A, 133B (the driving motors 113A, 113B) to the driver support 123, so that the driver 121 can provide a higher striking force. Further, the pair flywheels 133A, 133B (the driving motors 113A, 113B) can be readily and economically synchronized.

In the present embodiment, the pair flywheels 133A, 133B are individually driven by the two driving motors 113A, 113B. With this construction, a power transmission method using a belt which is looped in parallel can be adopted. In this method, for example, a V-belt having a plurality of V-shaped ridges (or possibly one ridge) can be used as the driving belts 145A, 145B. The V-belt has a higher efficiency of power transmission compared with a round belt having a circular section. Therefore, the pair flywheels 133A, 133B can be driven with efficiency and thus the striking force of the driver 121 can be further increased.

In the construction in which the two driving motors 113A, 113B are arranged (in V configuration) such that their respective axes of rotation form a V-shape when viewed from the direction of movement of the driver support 123, if the driving motors 113A, 113B are long in the axial direction, the motors may interfere with each other at one end in the axial direction. If the space between the motors is opened up in order to avoid such interference, the body 101 increases in width. According to this embodiment, the two driving motors 113A, 113B are arranged in positions displaced from each other in the driving direction of the driver support 123. In this manner, interference between the driving motors 113A, 113B at one axial end can be avoided. Specifically, according to this embodiment, increase in the width of the body 110 or the width of the nailing machine 100 can be rationally minimized so that it can be made compact in size.

(Second Embodiment)

Figure 15:
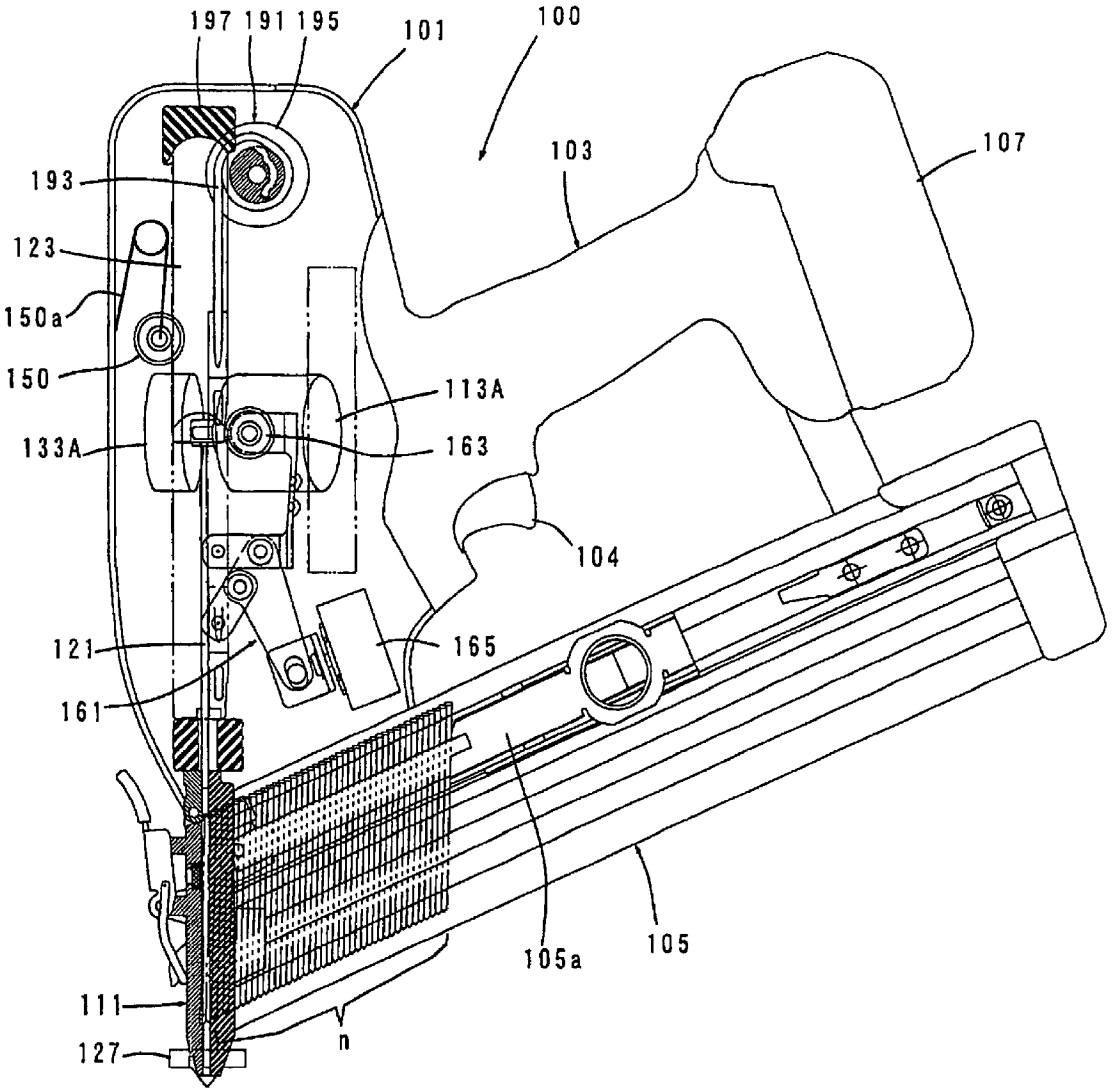
FIG. 15 is a side view showing an entire construction of a nailing machine according to a second embodiment of the invention.
Figure 16:
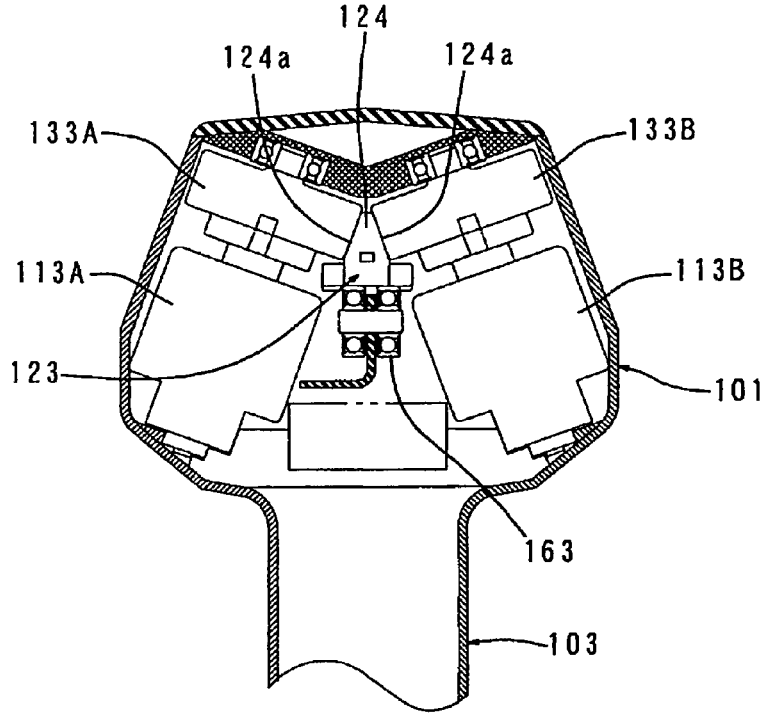
FIG. 16 is a sectional plan view showing a first example of placement of flywheels and motors in the second embodiment.
Figure 17:
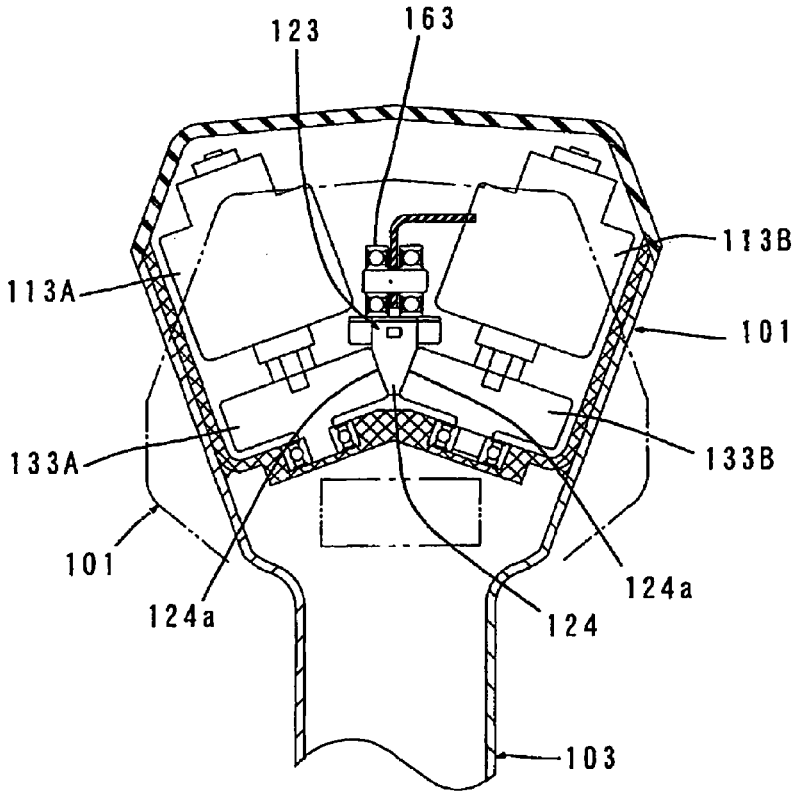
FIG. 17 is a sectional plan view showing a second example of placement of the flywheels and the motors in the second embodiment.

A second embodiment of the invention is now described with reference to FIGS. 15 to 17. FIG. 15 is a side view showing the entire nailing machine 100 according to the second embodiment. FIG. 16 is a sectional plan view showing a first example of placement of the flywheels and the motors in V configuration, and FIG. 17 is a sectional plan view showing a second example of placement of the flywheels and the motors in V configuration.

In the second embodiment, the pair flywheels 133A, 133B are directly driven by the driving motors 113A, 113B without using any power transmission member (by a direct coupling method). In the other points, it has almost the same construction as the above-described first embodiment. Therefore, description is omitted except for the method of direct coupling of the flywheels and the motors and its related constructions. Further, components which are substantially identical to those in the first embodiment are given like numerals as in the first embodiment.

In the first example of placement, as shown in FIG. 16, the two driving motors 113A, 113B and the pair flywheels 133A, 133B are arranged such that their respective axes of rotation form an inverted V-shape when the user holding the handle 103 views the body 101 from the rear in the direction of movement of the driver 121. In other words, the two driving motors 113A, 113B and the pair flywheels 133A, 133B are arranged in V configuration in which their axes of rotation open up from an upper region within the body 101 or from the front (above as viewed in FIG. 16) in the pressing direction of the pressure roller 163 toward the handle 103 side.

In FIG. 16, the flywheels 133A, 133B are arranged within the upper region of the body 101, and the driving motors 113A, 113B are arranged in the lower region of the body 101 (on the handle 103 side).

In the second example of placement, as shown in FIG. 17, the two driving motors 113A, 113B and the pair flywheels 133A, 133B are arranged in V configuration when the user holding the handle 103 views the body 101 from the rear in the direction of movement of the driver 121. In other words, the two driving motors 113A, 113B and the pair flywheels 133A, 133B are arranged in V configuration in which their axes of rotation come closer to each other from an upper region (upper side as viewed in FIG. 17) within the body 101 toward the handle 103 side.

In FIG. 17, the driving motors 113A, 113B are arranged in the upper region within the body 101, and the flywheels 133A, 133B are arranged in the lower region (on the handle 103 side) within the body 101.

In the second embodiment, a direct coupling method is used in which the flywheels 133A, 133B are arranged on the output shafts of the driving motors 113A, 113B. Compared with the method in which power transmission is effected via a power transmission member (the driving belts 145A, 145B), this method is advantageous in that no loss of power transmission is caused, no trouble is caused relating to the power transmission part, and the entire length of the nailing machine 100 (the length in the vertical direction in FIG. 16) can be shortened (in the construction in which the power transmission member is provided, the power transmission member is placed while avoiding interference with the other members, so that the entire length may be increased).

Further, in the first example of placement shown in FIG. 16, compared with the second example of placement shown in FIG. 17 (the contour of the body 101 in the first example of placement is shown by two-dot chain line in FIG. 17), the width (in the horizontal direction in FIGS. 16 and 17) of the upper part (on the upper side as viewed in FIGS. 16 and 17) of the body 101 can be reduced. As a result, when the user performs a nail driving operation, visibility of a nail driving point on the workpiece can be enhanced.

The invention is not limited to the above-described embodiments, but rather, may be added to, changed, replaced with alternatives or otherwise modified without departing from the spirit and scope of the invention.

In the first embodiment, the rotational outputs of the two driving motors 113A, 113B are transmitted to the pair flywheels 133A, 133B via the power transmission part, while, in the second embodiment, the two driving motors 113A, 113B are directly coupled to the pair flywheels 133A, 133B. The both methods in the first and second embodiments, however, may be used in combination. Specifically, the method using the power transmission part may be used for one of the flywheels 133A, while the direct coupling method may be used for the other flywheel 133B.

Further, the above-described motors are used as the driving motors 113A, 113B in order to readily and economically synchronize the rotational speeds, but other types of motors can be used only if the rotational speeds of the pair flywheels 133A, 133B (the driving motors 113A, 113B) can be synchronized. Alternatively, a synchronizer for synchronizing the rotational speeds of the pair flywheels 133A, 133B (the driving motors 113A, 113B) can also be used. For example, the synchronizer serves to detect loads on the driving motors 113A, 113B and reduce the rotational speed of one of the driving motors which is under a heavier load.

Further, the driver support 123 is described as being driven by the two flywheels 133A, 133B, but it may be driven by three or more flywheels. If the three or more flywheels are individually driven by respective driving motors, the rotational speeds of the driving motors must be synchronized.

The battery voltage reduction inhibiting device may be dispensed with.

Further, as the power transmission member, a round belt, a timing belt (toothed belt) or a gear may be used in place of the V-belt.

Further, in the above-described embodiments, the pair flywheels 133A, 133B are described as being arranged such that their respective axes of rotation form a V-shape so as to conform to the power transmission part 124 of the driver support 123 which has a V-shaped section. It is however only necessary that, in order to conform to the power transmission surfaces (first and second contact surfaces) 124*a* provided on the driver support (movable element) 123 and extending such that a space between the contact surfaces is lessened toward the front in the pressing direction of the pressure roller (pressing member) 163, the contact surfaces of the flywheels (first and second rotating elements) 133A, 133B which contact the power transmission surfaces also extend such that a space between the contact surfaces is lessened toward the front in the pressing direction of the pressure roller (pressing member) 163. For example, each of the flywheels 133A, 133B may be configured to have a circumferential surface formed by a conically inclined surface which has an inclination corresponding to the inclination of the surface of the power transmission part 124 having a V-shaped section, and the flywheels 133A, 133B may be arranged such that their axes of rotation are parallel to each other.

Description Of Numerals

100 nailing machine (driving tool)
101 body
103 handle
104 trigger
105 magazine
105*a* pressure plate
107 battery pack
110 body housing
111 driver guide
111*a* nail injection hole
113A, 113B driving motor (first and second motors)
115A, 115B driving pulley
117 nail driving mechanism
121 driver (movable element)
123 driver support (movable element)
124 power transmission part
124*a* power transmission surface
127 contact arm
131 drive mechanism
133A, 133B flywheel (pair of rotating elements)
135A, 135B shaft
137 bearing
143A, 143B driven pulley
145A, 145B driving belt
161 pressing mechanism
163 pressure roller
165 electromagnetic actuator
166 output shaft
167 compression spring
169 bracket
169*a* connecting hole
171 actuating arm
173 connecting shaft
175 first movable shaft
177 control arm
179 first fixed shaft
181 second movable shaft
183 pressure arm
185 second fixed shaft
191 return mechanism
193 return rubber
195 winding wheel
195*a* winding shaft
197 stopper
197*a* contact surface

The invention claimed is:

1. A driving tool for driving a material to be driven into a workpiece comprising:

first and second rotating elements which are spaced apart from each other and rotationally driven, a movable element that moves in a direction that strikes the material to be driven, a pressing member that presses the movable element toward the first and second rotating elements from a direction transverse to the direction of movement of the movable element, first and second contact surfaces provided on the movable element and extending along the direction of movement of the movable element such that the first and second contact surfaces form a V-shaped section, the contact surfaces being brought into contact with the first and second rotating elements when the pressing member presses the movable element, wherein the movable element is moved by a rotating force of the first and second rotating elements in a direction that strikes the material to be driven when the first and second contact surfaces come into contact with the first and second rotating elements, a first motor that drives the first rotating element, a second motor that is provided separately from the first motor and drives the second rotating element, a housing that houses the first and second motors and the first and second rotating elements, and a handle to be held by a user, which is connected to the housing and extends in a direction transverse to the longitudinal direction of the housing, wherein the first and second motors are arranged in a V configuration such that their axes of rotation open up from the front in the pressing direction of the pressing member toward the handle side.

2. The driving tool as defined in claim 1, wherein the first and second motors are spaced apart from each other in the direction of movement of the movable element.

3. The driving tool as defined in claim 1, wherein the first rotating element is provided on an output shaft of the first motor, and the second rotating element is provided on an output shaft of the second motor.

4. The driving tool as defined in claim 1, wherein rotational outputs of the motors are transmitted to the rotating elements via V-belts.

5. The driving tool as defined in claim 1, wherein rotational outputs of the motors are directly transmitted to the rotating elements without using any intervening member.

6. The driving tool as defined in claim 1, wherein rotational speeds of the first and second motors are synchronized.

7. A driving tool for driving a material to be driven into a workpiece comprising:

first and second rotating elements which are spaced apart from each other and rotationally driven, a movable element that moves in a direction that strikes the material to be driven, a pressing member that presses the movable element toward the first and second rotating elements from a direction transverse to the direction of movement of the movable element, and first and second contact surfaces provided on the movable element and extending along the direction of movement of the movable element such that a space between the contact surfaces decreases in a pressing direction of the pressing member, the contact surfaces being brought into contact with the first and second rotating elements when the pressing member presses the movable element, wherein the movable element is moved by a rotating force of the first and second rotating elements in a direction that strikes the material to be driven when the first and second contact surfaces come into contact with the first and second rotating elements, including:

a first motor that drives the first rotating element and a second motor that is provided separately from the first motor and drives the second rotating element, the first motor and the second motor being arranged such that an axis of rotation of the first motor and an axis of rotation of the second motor form a V-shape when viewed from a direction of movement of the movable element.

* * * * *